US011154882B2

(12) United States Patent
Nelson et al.

(10) Patent No.: US 11,154,882 B2
(45) Date of Patent: Oct. 26, 2021

(54) CAGE DESIGN WITH MODIFIED STRUTS INCLUDING ORIENTED FINS

(71) Applicant: Nelson Irrigation Corporation, Walla Walla, WA (US)

(72) Inventors: Craig B. Nelson, Walla Walla, WA (US); Andrew B. Hellie, College Place, WA (US); Sean M. Scott, Walla Walla, WA (US)

(73) Assignee: NELSON IRRIGATION CORPORATION, Walla Walla, WA (US)

( * ) Notice: Subject to any disclaimer, the term of this patent is extended or adjusted under 35 U.S.C. 154(b) by 59 days.

(21) Appl. No.: 16/216,042

(22) Filed: Dec. 11, 2018

(65) Prior Publication Data

US 2020/0179960 A1 Jun. 11, 2020

(51) Int. Cl.

| | |
|---|---|
| ***B05B 3/08*** | (2006.01) |
| ***B05B 3/00*** | (2006.01) |
| ***B05B 3/04*** | (2006.01) |
| *B05B 3/06* | (2006.01) |

(52) U.S. Cl.

CPC ..... *B05B 3/08* (2013.01); *B05B 3/003* (2013.01); *B05B 3/0486* (2013.01); *B05B 3/063* (2013.01); *B05B 3/066* (2013.01)

(58) Field of Classification Search

CPC ..... B05B 15/065; B05B 3/005; B05B 3/003; B05B 3/0486; B05B 3/063; B05B 3/08; B05B 3/1007

USPC .... 239/222, 222.11, 222.13, 222.15, 222.17, 239/222.21, 231, 232, 600

See application file for complete search history.

(56) References Cited

U.S. PATENT DOCUMENTS

| | | | | |
|---|---|---|---|---|
| 2,488,234 | A * | 11/1949 | Perry | B05B 3/0486 239/222.17 |
| D258,754 | S * | 3/1981 | Addison | D23/214 |
| 5,297,737 | A * | 3/1994 | Davisson | B05B 3/005 239/222.17 |
| 5,372,307 | A | 12/1994 | Sesser | |
| 5,377,914 | A | 1/1995 | Christen | |
| 5,439,174 | A | 8/1995 | Sweet | |
| 5,588,595 | A | 12/1996 | Sweet et al. | |
| 5,671,885 | A | 9/1997 | Davisson | |
| 5,671,886 | A * | 9/1997 | Sesser | B05B 3/005 239/222.21 |
| 5,992,760 | A | 11/1999 | Kearby et al. | |
| 6,607,147 | B2 | 8/2003 | Schneider et al. | |
| 7,100,842 | B2 | 9/2006 | Meyer et al. | |
| 7,287,710 | B1 | 10/2007 | Nelson et al. | |
| 7,300,004 | B2 | 11/2007 | Sinden et al. | |
| 7,562,833 | B2 | 7/2009 | Perkins et al. | |

(Continued)

*Primary Examiner* — Qingzhang Zhou

(74) *Attorney, Agent, or Firm* — Nixon & Vanderhye P.C.

(57) ABSTRACT

A sprinkler body for a rotating sprinkler includes a base securable to a source of water under pressure, a plurality of support struts connected to and extending from the base, and a deflector plate support connected to the plurality of support struts and disposed spaced from the base by the support struts. At least one of the plurality of support struts is wedge-shaped with an inward-facing apex. The support struts are configured to create a void in the water spray pattern away from a center pivot pipe and to direct the water spray downward to limit the effect of wind on the spray pattern.

15 Claims, 4 Drawing Sheets

(56) References Cited

U.S. PATENT DOCUMENTS

| | | | | |
|---|---|---|---|---|
| 7,603,726 | B2 * | 10/2009 | Sawalski | B65D 83/20 4/223 |
| 7,789,323 | B2 | 9/2010 | Nelson et al. | |
| 7,942,345 | B2 | 5/2011 | Sesser et al. | |
| 7,980,488 | B2 | 7/2011 | Townsend | |
| 8,028,932 | B2 | 10/2011 | Sesser et al. | |
| 8,336,788 | B2 | 12/2012 | Perkins et al. | |
| 8,567,699 | B2 | 10/2013 | Sesser et al. | |
| 8,991,724 | B2 | 3/2015 | Sesser et al. | |
| 8,998,107 | B2 | 4/2015 | Sesser et al. | |
| 9,095,859 | B2 | 8/2015 | Sesser et al. | |
| 9,700,904 | B2 * | 7/2017 | Kim | B05B 3/003 |

* cited by examiner

CAGE DESIGN WITH MODIFIED STRUTS INCLUDING ORIENTED FINS

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND

The invention relates to rotating sprinklers and, more particularly, to a sprinkler body for a rotating sprinkler with modified struts.

There are currently rotating sprinklers that include a base member coupled with a source of water under pressure connected to a deflector plate support via a plurality of struts. The deflector plate support may support a deflector plate toward which water is directed through a nozzle in the base. The deflector plate distributes the water outward between and across the struts in a desired spray pattern.

These sprinklers typically include three struts spaced 120 degrees apart. Water from the deflector plate that hits the struts may be blown in the wind and/or may result in undesirable drool from the sprinkler.

Additionally, there are numerous existing sprinkler assemblies that endeavor to prevent voids in the spray pattern that may be caused by the struts. One type utilizes struts that are shaped similar to an airplane wing such that the water stream splits around the strut and then comes back together after it passes the strut so that there is no void in the water pattern.

For an "up-top" rotating sprinkler, that is, a sprinkler mounted on the top of a center pivot, water hitting the pivot pipe tends to drool off the pivot pipe, resulting in unwanted and uncontrolled water directly beneath the pivot pipe.

BRIEF SUMMARY

There is thus a need for a rotating sprinkler assembly including a sprinkler body that addresses the shortcomings in existing designs. In some embodiments, the support struts of the sprinkler body are provided with fins that deflect water in a downward direction so that water hitting the struts is deflected to the ground rather than being blown away with the wind or creating drool from the sprinkler.

Additionally, in some embodiments, the sprinkler body may be provided with two struts rather than three struts, with the two support struts oriented in line with the center pivot pipe. In this context, the support struts may be wedge-shaped so as to purposefully create a void in the water spray pattern to avoid contact with the pivot pipe.

In an exemplary embodiment, a sprinkler body for a rotating sprinkler includes a base securable to a source of water under pressure, a plurality of support struts, which may consist of two support struts, connected to and extending from the base, and a deflector plate support connected to the plurality of support struts and disposed spaced from the base by the support struts. At least one of the plurality of support struts is wedge-shaped with an inward-facing apex.

The at least one of the plurality of support struts may include deflection fins that protrude from an inward-facing surface thereof. The deflection fins may be angled downward in a radially outward direction.

In some embodiments, the sprinkler body includes a pair of the support struts, where each of the pair of support struts may be wedge-shaped with an inward-facing apex. In this context, each of the pair of support struts may include deflection fins that protrude from an inward-facing surface thereof. The deflection fins may be angled downward in a radially outward direction. The wedge-shape of the support struts may include the inward-facing apex and two of the inward-facing surfaces extending outward from the apex, respectively, where both of the two inward-facing surfaces may include the deflection fins. In this context, the deflection fins on one of the two inward-facing surfaces may be symmetrical with the deflection fins on the other of the two inward-facing surfaces.

In some embodiments, the pair of support struts may be spaced 180 degrees apart.

In another exemplary embodiment, a sprinkler includes the sprinkler body of the described embodiments, a rotating deflector plate secured to the deflector plate support, and a nozzle secured in the base and configured to direct the water under pressure toward the deflector plate.

In yet another exemplary embodiment, a method of installing and operating a rotating sprinkler on top of a center pivot pipe includes the step of (a) securing the base to the center pivot pipe in fluid communication with the center pivot pipe; and (b) creating a void in a pattern of water spray in line with the center pivot pipe. Step (b) may be practiced by aligning the support struts with the center pivot pipe. The method may further include deflecting the water spray with the deflection fins, preferably downwardly.

BRIEF DESCRIPTION OF THE DRAWINGS

These and other aspects and advantages will be described in detail with reference to the accompanying drawings, in which.

DETAILED DESCRIPTION

Figure 1:
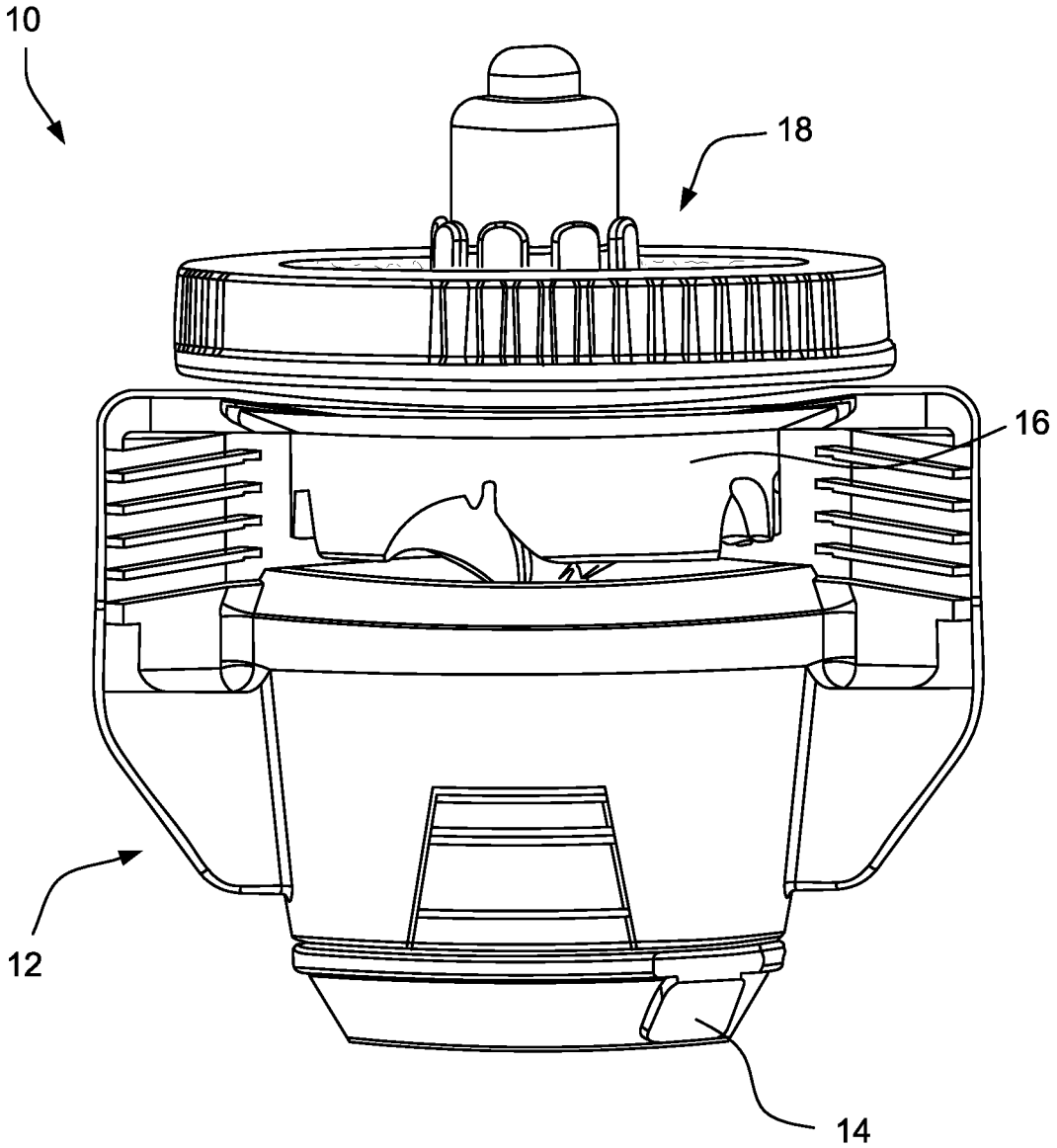
FIG. 1 shows a rotating sprinkler assembly including a sprinkler body of the described embodiments.

With reference to FIG. 1, a rotating sprinkler assembly 10 includes a sprinkler body 12 securing a nozzle component 14, a deflector plate 16, and a brake assembly 18. In use, water flows through the nozzle component 14, which includes a nozzle, and is directed by the nozzle component 14 to the deflector plate 16. The deflector plate 16 includes a plurality of grooves and lands that serve to direct water outward from the sprinkler assembly in a predefined spray pattern. The structure of the deflector plate 16 also causes the deflector plate 16 to rotate when impacted with water under pressure. The brake assembly 18 serves to attenuate the rotating velocity of the deflector plate 16.

Figure 2:
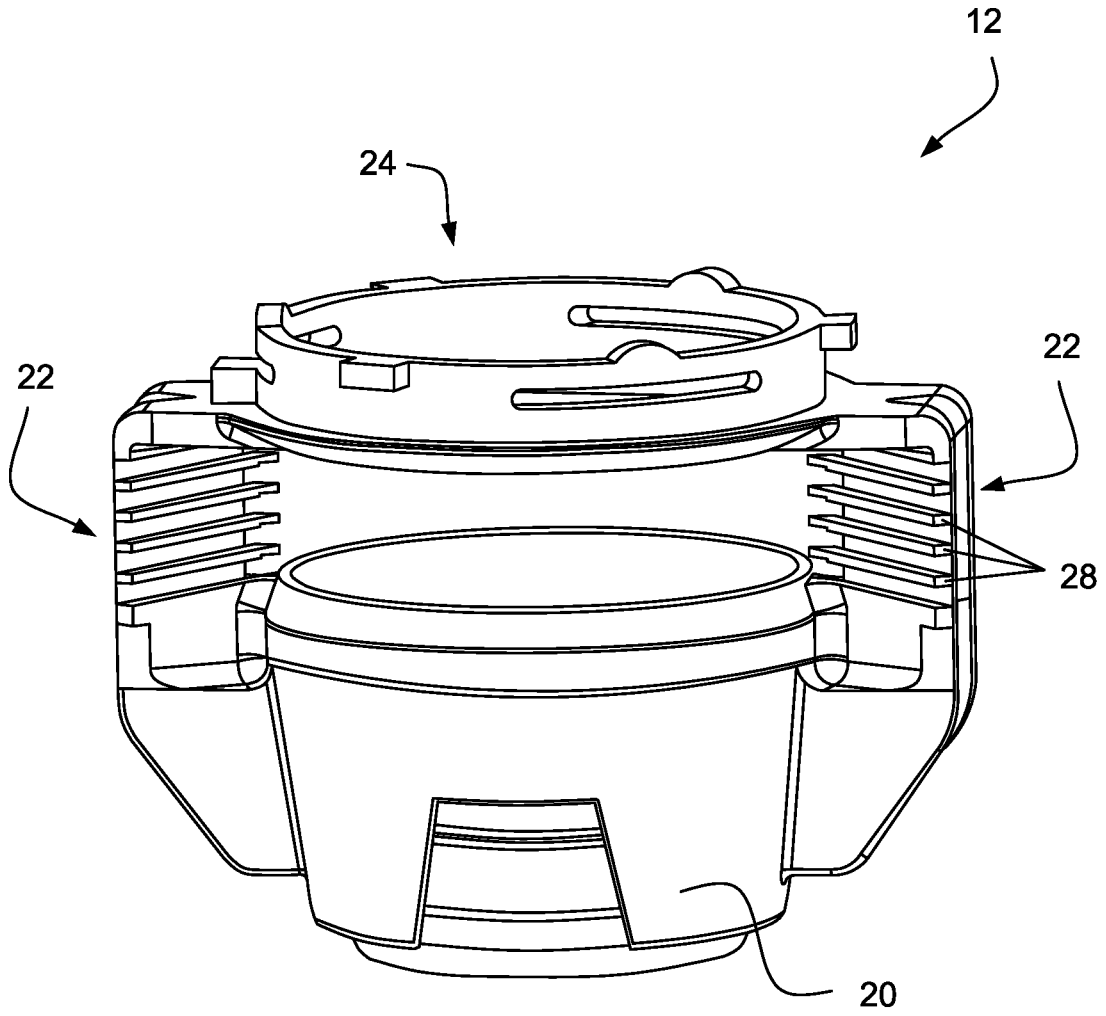
FIG. 2 is a view of the sprinkler body.
Figure 3:
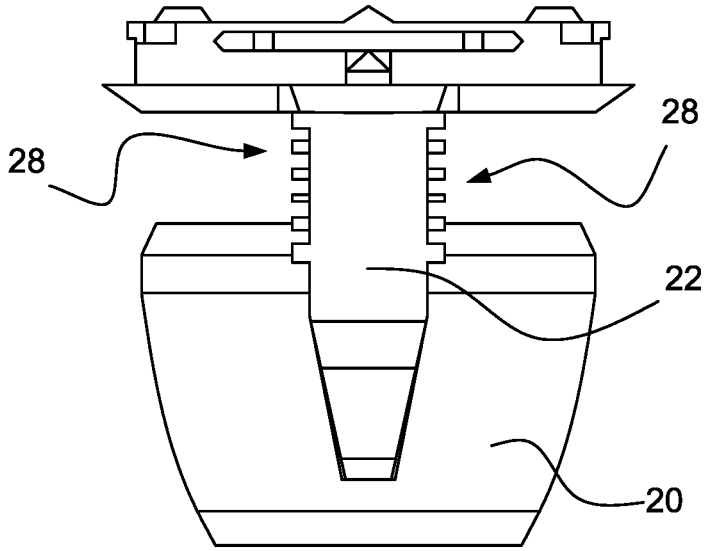
FIG. 3 is a side view of the sprinkler body.
Figure 4:
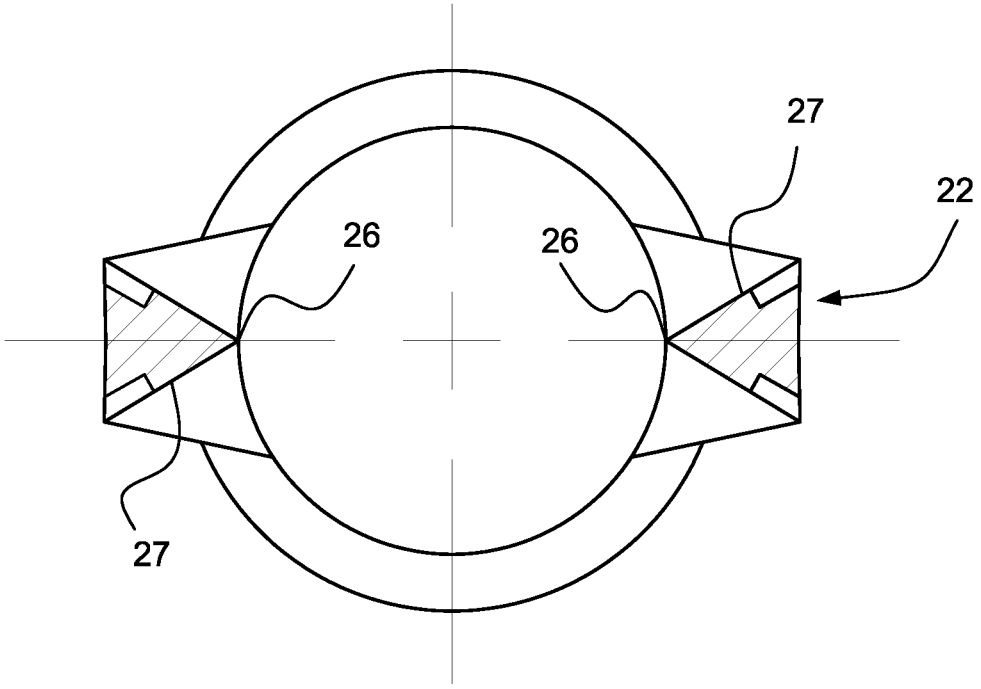
FIG. 4 is a cross-sectional view through the struts of the sprinkler body.

FIGS. 2-4 show details of the sprinkler body 12. The sprinkler body 12 includes a base 20 securable to a source of water under pressure. In some embodiments, described in more detail below, the base 20 is securable to a center pivot pipe. The base 20 secures the nozzle component 14 through which water under pressure flows.

At least two support struts 22 are connected to and extend from the base 20 as shown. The support struts 22 extend up and over the base 20 and are connected to a deflector plate support 24. The deflector plate support 24 is thus disposed spaced from the base 20 by the support struts 22. The deflector plate support 24 includes notches and grooves and the like to secure the brake assembly 18 and the deflector plate 16. In some embodiments, the deflector plate support 24, the support struts 22 and the base 20 are integrated into a single component, for example by molding.

In some embodiments, the sprinkler body 12 includes two support struts 22 positioned on diametric opposite sides of the base 20 (i.e., the support struts 22 may be spaced 180 degrees apart). That is, in some embodiments, the sprinkler body 12 includes only two of the support struts 22. FIG. 4 is a cross-sectional view of the sprinkler body 12 through the support struts 22. As shown, the support struts 22 may be wedge-shaped with an inward-facing apex 26 and two inward-facing surfaces 27 extending outward from the apex 26.

Additionally, the support struts 22 may be provided with deflection fins 28 on one or both inward-facing surfaces 27 of the wedge-shape. The deflection fins 28 protrude from the inward-facing surfaces 27. In some embodiments, the deflection fins 28 are angled downward in a radially outward direction. That is, water that is deflected by the deflector plate 16 and impacts the support struts 22 is directed downward by the deflection fins 28 as the water travels radially outward. In some embodiments, the deflection fins 28 on one of the two inward-facing surfaces 27 of the support struts 22 are symmetrical with the deflection fins 28 on the other of the two inward-facing surfaces.

Figure 5:
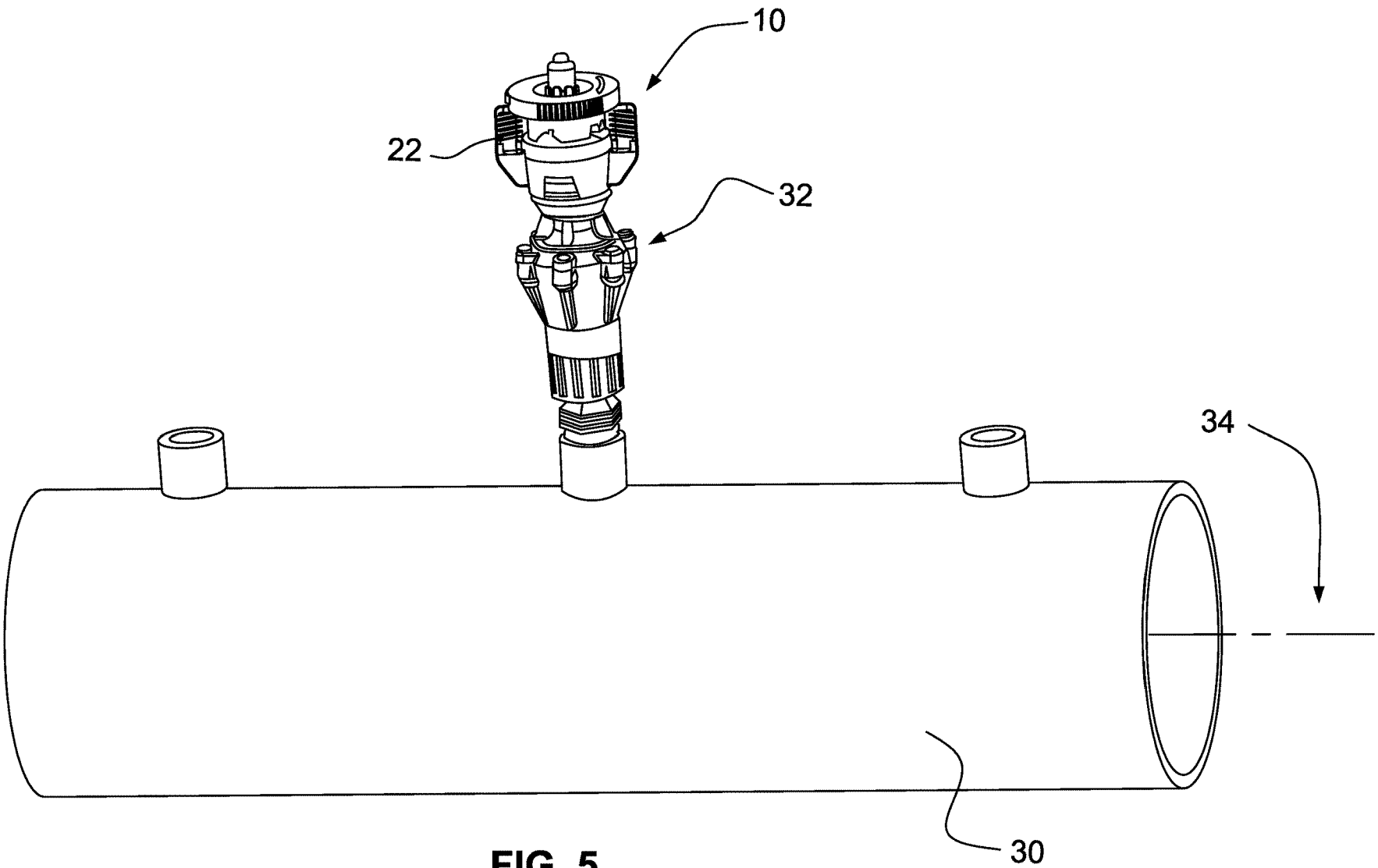
FIG. 5 shows a rotating sprinkler assembly including the sprinkler body of the described embodiments mounted on a center pivot pipe.

FIG. 5 shows an exemplary application with the sprinkler assembly 10 secured on a center pivot pipe 30. A pressure regulator 32 may be interposed between the center pivot pipe 30 and the rotating sprinkler assembly 10.

In the embodiment shown, the sprinkler body 12 includes two support struts 22 spaced 180 degrees apart. The support struts 22 are installed in alignment with a longitudinal axis 34 of the center pivot pipe 30. In this manner, the support struts 22 displace the water from the deflector plate by virtue of the wedge-shape of the support struts 22, thereby creating a void in the pattern of water spray in line with the center pivot pipe 30. Moreover, the deflection fins 28 that protrude from each of the two inward-facing surfaces 27 of the support struts 22 serve to deflect the water spray, preferably downward. By creating the void in the water spray pattern away from the center pivot pipe, the amount of water hitting the pivot pipe that tends to drool off the pivot pipe can be reduced. Additionally, by deflecting the water downward with the deflection fins, water hitting the struts may be deflected toward the ground rather than being blown away with the wind or creating drool from the sprinkler.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A sprinkler body for a rotating sprinkler, the sprinkler body comprising:

a base securable to a source of water under pressure, the base having a central axis;

a plurality of support struts connected to and extending from the base; and a deflector plate support connected to the plurality of support struts and disposed spaced from the base by the support struts, wherein at least one of the plurality of support struts is wedge-shaped with an apex facing the central axis that is oriented to create a void in a water spray pattern, and wherein the at least one of the plurality of support struts comprises a plurality of deflection fins that are spaced from one another and positioned along a length and across a middle of the at least one of the plurality of support struts and that protrude from an inward-facing surface thereof, wherein the deflection fins are angled downward in a direction radially outward from the central axis, and wherein water that impacts the support struts is directed downward by the deflection fins.

2. A sprinkler body according to claim 1, comprising a pair of the support struts, wherein each of the pair of support struts is wedge-shaped with an apex facing the central axis that is oriented to create the void in the water spray pattern.

3. A sprinkler body according to claim 2, wherein each of the pair of support struts comprises deflection fins that protrude from an inward-facing surface thereof.

4. A sprinkler body according to claim 3, wherein the wedge-shape of the support struts includes the apex and two of the inward-facing surfaces extending outward from the apex, respectively, wherein both of the two inward-facing surfaces comprise the deflection fins.

5. A sprinkler body according to claim 4, wherein the deflection fins on one of the two inward-facing surfaces are symmetrical with the deflection fins on the other of the two inward-facing surfaces.

6. A sprinkler body according to claim 2, wherein the pair of support struts are spaced 180 degrees apart.

7. A sprinkler body according to claim 1, comprising a pair of the support struts, wherein each of the pair of support struts is wedge-shaped with an apex facing the central axis, and wherein the pair of support struts are spaced 180 degrees apart.

8. A sprinkler body according to claim 1, wherein the plurality of support struts consists of two support struts.

9. A sprinkler body for a rotating sprinkler, the sprinkler body comprising:

a base securable to a source of water under pressure, the base having a central axis;

a pair of support struts connected to and extending from the base, the support struts being spaced 180 degrees apart; and a deflector plate support connected to the pair of support struts and disposed spaced from the base by the support struts, wherein each of the pair of support struts is wedge-shaped with an apex facing the central axis and two inward-facing surfaces extending outward from the apex that are oriented to create a void in a water spray pattern, each of the support struts comprising a plurality of deflection fins that are spaced from one another and positioned along a length and across a middle of the support struts and that protrude from each of the two inward-facing surfaces, and wherein the deflection fins are angled downward in a radially outward direction, wherein water that impacts the support struts is directed downward by the deflection fins.

10. A sprinkler body according to claim 9, wherein on each of the support struts, the deflection fins on one of the two inward-facing surfaces are symmetrical with the deflection fins on the other of the two inward-facing surfaces.

11. A sprinkler comprising the sprinkler body of claim 9, a rotating deflector plate secured to the deflector plate support, and a nozzle secured in the base and being configured to direct the water under pressure toward the deflector plate.

12. A sprinkler body according to claim 1, wherein the deflection fins are angled only downward in a direction radially outward from the central axis.

13. A sprinkler body according to claim 1, wherein the deflection fins extend beyond a widest portion of the at least one of the plurality of support struts.

14. A sprinkler body according to claim 9, wherein the deflection fins are angled only downward in a direction radially outward from the central axis.

15. A sprinkler body according to claim 9, wherein the deflection fins extend beyond a widest portion of the support struts.

* * * * *